US012778305B2

(12) United States Patent
Chen

(10) Patent No.: US 12,778,305 B2
(45) Date of Patent: Nov. 3, 2026

(54) BUNK BED

(71) Applicant: James Chen, City of Industry, CA (US)

(72) Inventor: James Chen, City of Industry, CA (US)

( * ) Notice: Subject to any disclaimer, the term of this patent is extended or adjusted under 35 U.S.C. 154(b) by 887 days.

(21) Appl. No.: 18/193,632

(22) Filed: Mar. 31, 2023

(65) Prior Publication Data

US 2024/0324785 A1 Oct. 3, 2024

(51) Int. Cl.

*A47C 19/20* (2006.01)
*A47C 19/00* (2006.01)
*A47C 19/02* (2006.01)

(52) U.S. Cl.

CPC ..... *A47C 19/20* (2013.01); *A47C 19/005* (2013.01); *A47C 19/024* (2013.01); *A47C 19/202* (2013.01); *A47C 19/021* (2013.01)

(58) Field of Classification Search

CPC ..... A47C 19/20; A47C 19/202; A47C 19/005; A47C 19/02; A47C 19/021; A47C 19/024; A47C 19/00
USPC ..... 5/9.1, 8, 285, 279.1
See application file for complete search history.

(56) References Cited

U.S. PATENT DOCUMENTS 695,820 A * 3/1902 Locher ..... A47C 19/20 5/9.1
3,008,534 A * 11/1961 Von Canon, Jr. ..... A47C 19/20 5/8
3,736,605 A * 6/1973 Klein, Jr. ..... A47C 4/021 601/24
4,193,146 A * 3/1980 Fredman ..... A47C 19/20 5/8
4,940,149 A * 7/1990 Vineis ..... F16B 12/24 211/186
5,003,650 A * 4/1991 Caya ..... A47C 19/20 5/507.1
5,111,540 A * 5/1992 Caya ..... A47C 19/20 403/403
5,233,707 A * 8/1993 Perkins ..... A47C 19/205 5/8
7,200,880 B2 * 4/2007 Mazza ..... A47C 19/005 5/2.1
2006/0143824 A1 * 7/2006 Mazza ..... F16B 12/02 5/9.1
2024/0324785 A1 * 10/2024 Chen ..... A47C 19/005

* cited by examiner

*Primary Examiner* — Robert G Santos
(74) *Attorney, Agent, or Firm* — Clement Cheng

(57) ABSTRACT

A bunk bed frame includes a lower bed frame and an upper bed frame. The lower bed frame and the upper bed frame both have four corner legs and at least one pair of middle legs. A rectangular configuration is adapted for a full size mattress. The corner legs and middle legs providing support for the mattress. A middle leg lap vertical splice joint connects the pair of middle legs. The middle leg lap vertical splice joint includes a first lap connection on the upper end of the lower middle leg, a second lap connection on the lower end of the upper middle leg, and a lap interface plane connecting the first and second lap connections.

14 Claims, 10 Drawing Sheets

BUNK BED

FIELD OF THE INVENTION

The present invention is in the field of bunk beds.

DISCUSSION OF RELATED ART

Bunk beds have been a popular choice for maximizing space and accommodating more individuals in a limited area. The current state of the art for bunk bed frames has evolved over time with advancements in technology, design, and materials. A variety of different bunk bed structures have been disclosed in the prior art.

Bunk beds have been a popular choice for maximizing space and accommodating more individuals in a limited area. The current state of the art for bunk bed frames has evolved over time with advancements in technology, design, and materials. A variety of different bunk bed structures have been disclosed in the prior art, including knockdown and foldable bunk bed frames, metal bunk bed frames that can be assembled and disassembled, and bunk bed frames provided with ladders and guard rails. Bunk bed frames continue to provide practical solutions for maximizing space and for accommodating more individuals in a limited area.

Thus, bunk bed frames have evolved over time with advancements in technology, design, and materials. From the early days of detachable and collapsible frames to the use of metal and plastic, and the recent innovations in safety and technology, bunk bed frames continue to provide practical solutions for maximizing space and accommodating more individuals. These patents and their related art provide a glimpse into the rich history of bunk bed frame design and the ongoing innovations that are driving the industry forward.

SUMMARY OF THE INVENTION

It is an object of the present invention to provide a compact bunk bed form structure which will optimize international ocean freight furniture shipping. A bunk bed frame includes a lower bed frame and an upper bed frame. The lower bed frame and the upper bed frame both have four corner legs and at least one pair of middle legs. A rectangular configuration is adapted for a full size mattress. The corner legs and middle legs providing support for the mattress. A middle leg lap vertical splice joint connects the pair of middle legs. The middle leg lap vertical splice joint includes a first lap connection on the upper end of the lower middle leg, a second lap connection on the lower end of the upper middle leg, and a lap interface plane connecting the first and second lap connections.

The middle leg lap vertical splice joint further includes a third lap connection on the lower end of the lower middle leg; and a fourth lap connection on the upper end of the upper middle leg. The corner legs are formed as rectangular prism elongated posts having a rectangular cross-section. The corner legs have connector openings to allow connection between the vertically oriented corner legs and horizontal connecting members.

The ladder allows for accessing the upper bed frame while improving stability. Ladder legs are connected to the upper bed frame and the lower bed frame. The ladder legs having notches for connecting to the lower bed frame and to the upper bed frame. The ladder legs optionally include a lower first ladder leg notch on the lower first ladder leg; a lower middle leg notch on the lower middle leg; an upper left ladder first notch on the upper left ladder leg; a lower second ladder leg notch on the lower second ladder leg; an upper right ladder first notch on the upper right ladder leg; an upper left ladder second notch on the upper left ladder leg; an upper right ladder second notch on the upper right ladder leg; and; an upper left ladder third notch on the upper left ladder leg.

The bunk bed frame can optionally include an upper right ladder connection on an upper end of the upper right ladder leg; an upper right ladder third notch on an upper end of the upper right ladder leg; an upper left ladder connection on an upper end of the upper left ladder leg; and a lower right ladder connection and a lower left ladder connection connected to the lower bed frame.

The middle legs are asymmetrical because one of the middle legs is a straight leg and the other middle leg is formed as a ladder. The middle legs include a rear middle leg and a front middle leg. The rear middle leg has a middle leg lap vertical splice joint. The middle leg lap vertical splice joint has a lap interface plane with a lower lap end that abuts the lower middle leg, and an upper lap end that abuts the upper middle leg. The ladder legs of the upper bed frame each have a first notch, a second notch, and a third notch. The middle horizontal splice junction has a half lap horizontal splice, a first splice screw hole, and a second splice screw hole. The upper bed frame is connected to two ladder legs forming a ladder with rungs connecting between the two ladder legs. The ladder legs have notches for connecting to the upper bed frame and to the lower bed frame. The lower bed frame is connected to a first ladder leg, a second ladder leg, and a middle leg. The first ladder leg has notches for connecting to the lower bed frame and to the upper bed frame.

BRIEF DISCUSSION OF THE DRAWINGS

The following call out list of elements can be useful guide in referencing the element numbers of the drawings.

10 Bunk Bed Frame

20 Lower Bed Frame

21 Lower First Leg

22 Lower Second Leg
23 Lower Third Leg
24 Lower Fourth Leg
25 Lower First Ladder Leg
26 Lower Second Ladder Leg
27 Lower Middle Leg
28 Lower Mattress Support
30 Upper Bed Frame
31 Upper First Leg
32 Upper Second Leg
33 Upper Third Leg
34 Upper Fourth Leg
35 Upper First Ladder Leg
35 Upper First Ladder Leg
36 Upper Second Ladder Leg
36 Upper Second Ladder Leg
37 Upper Middle Leg
38 Upper Mattress Support
41 Left Upper Connecting Board
42 Left Upper Connecting Beam
43 Left Upper Front Connection
43 Left Upper Front Connection
44 Left Upper Rear Connection
45 Screw Connector
46 Widthwise Screw Hole
47 Board Screw Hole
49 End Cap
50 Middle Horizontal Splice Junction
51 Half Lap Horizontal Splice
52 First Splice Screw Hole
53 Second Splice Screw Hole
54 Upper Right Beam
55 Upper Left Beam
56 Middle Right Beam
58 Lower Right Beam
59 Middle Lower Beam
60 Middle Leg Lap Vertical
61 First Lap Connection
62 Second Lap Connection
63 Third Lap Connection
64 Fourth Lap Connection
65 Lap Interface Plane
66 Lower Lap End
67 Upper Lap End
37 Upper Middle Leg
80 Ladder
81 Lower First Ladder Leg Notch
83 Lower Middle Leg Notch
84 Upper Left Ladder First Notch
82 Lower 2nd Ladder Leg Notch
85 Upper Right Ladder First Notch
86 Upper Left Ladder 2nd Notch
87 Upper Right Ladder 2nd Notch
88 Upper Left Ladder 3rd Notch
91 Upper Right Ladder Connection
89 Upper Right Ladder 3rd Notch
92 Upper Left Ladder Connection
93 Lower Right Ladder Connection
94 Lower Left Ladder Connection
154 Upper Notch
155 Middle Notch
156 Lower Notch
211 Right Rear Longitudinal Member
212 Left Rear Longitudinal Member
213 Right Front Longitudinal Member
214 Right Rear Longitudinal Member
215 Rear Longitudinal Member Connection
216 Front Longitudinal Member Connection
221 Right Rear Longitudinal Member Corner Connection
222 Left Rear Longitudinal Member Corner Connection
223 Right Front Longitudinal Member Corner Connection
224 Right Rear Longitudinal Member Corner Connection

DETAILED DESCRIPTION OF THE PREFERRED EMBODIMENT

Figure 1:
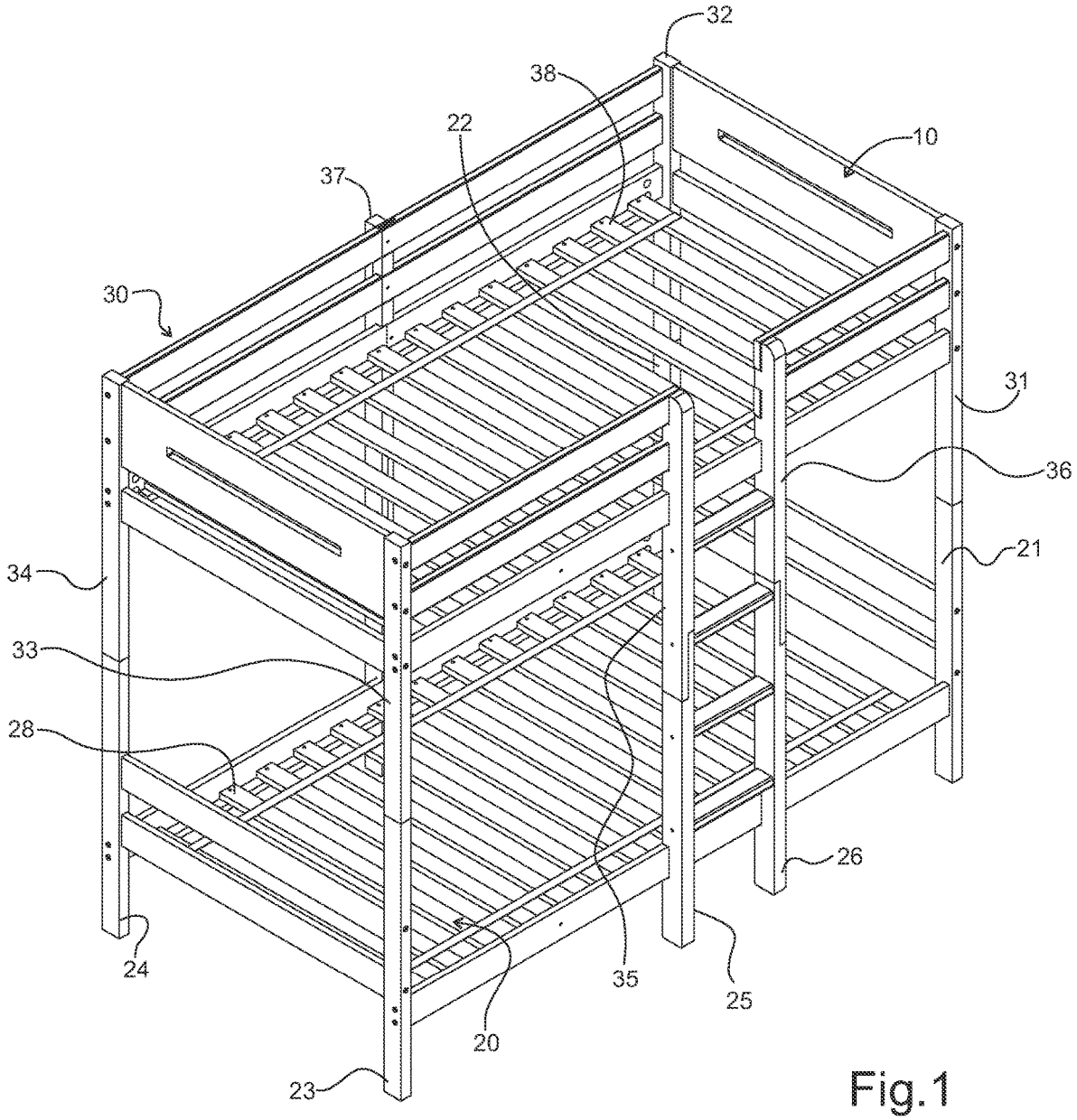
FIG. 1 is a perspective view of the present invention.

As seen in FIG. 1, a bunk bed frame 10 includes a lower bed frame 20 and an upper bed frame 30. The upper bed frame 30 is mounted over the lower bed frame 20. The bunkbed has a rectangular configuration for a mattress such as a full size mattress. The rectangular configuration of the bunkbed frame includes leg supports at each corner. The lower bed frame has a lower first leg 21, a lower second leg 22, a lower third leg 23, and the lower fourth leg 24. The lower first leg 21 and the lower second leg 22 can be mounted on a right side of the bunkbed frame 10, and the lower third led 23 and the lower fourth leg 24 can be mounted on the left side of the bunkbed frame 10. Similarly, the upper first leg 31 and the upper second leg 32 can be mounted on a right side of the bunkbed frame 10. The upper third leg 33 and the upper fourth light 34 can be mounted on a left side of the bunkbed frame 10. The lower first leg 21 supports the upper first leg 31 and is parallel to the upper first leg 31. The lower second leg 22 supports the upper second leg 32 and is parallel to the upper second leg 32. The lower third leg 23 supports the upper third leg 33 and is parallel to the upper third leg 33. The lower fourth leg 24 supports the upper fourth leg 34 and is parallel to the upper fourth leg 34. Each of the corner legs are preferably formed as a rectangular prism elongated post having a rectangular cross-section. Each of the corner legs preferably receive connector openings such as bolt openings or screw openings to allow connection between the vertically oriented corner legs and horizontal connecting members.

Between the corner legs, a pair of middle legs support the middle of the bunkbed to provide additional rigidity. The pair of middle legs is preferably asymmetrical such that a rear middle leg is formed as a post, whereas a front middle leg is formed as a ladder. The upper middle leg 37 is parallel to the lower middle leg 27 and preferably located generally between the uppers second leg 32 and the upper fourth leg 34. The upper middle leg preferably connects with the lower middle leg at a lap joint. The front middle leg comprises a lower first ladder leg 25 that supports an upper first letter leg 35 and a lower second ladder leg 26 that supports an upper second ladder leg 36. The vertical support structures therefore include seven lower legs supporting seven upper legs. The vertical support structures in turn support the horizontal support structures which support the upper mattress support 38 and the lower mattress support 28.

Figure 2:
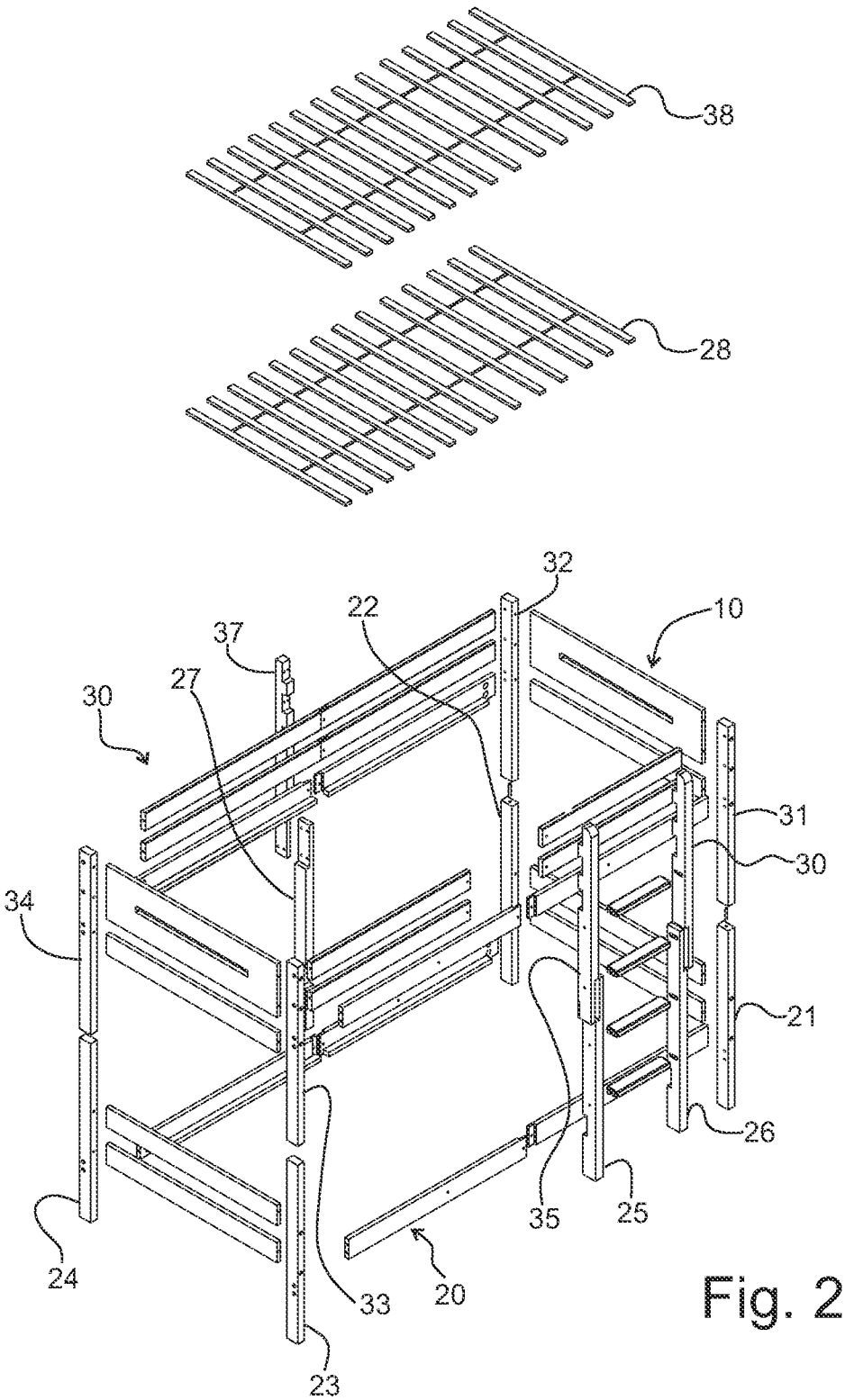
FIG. 2 is an exploded view of the present invention.

As seen in FIG. 2, the lower mattress support 28 and the upper mattress support 38 both of slats that are connected by cords, such as a pair of cords such that each of the series of slats can be rolled up into a compact member. An exploded view of the present invention bunkbed frame 10 shows the interconnection of the various members during assembly.

Figure 3:
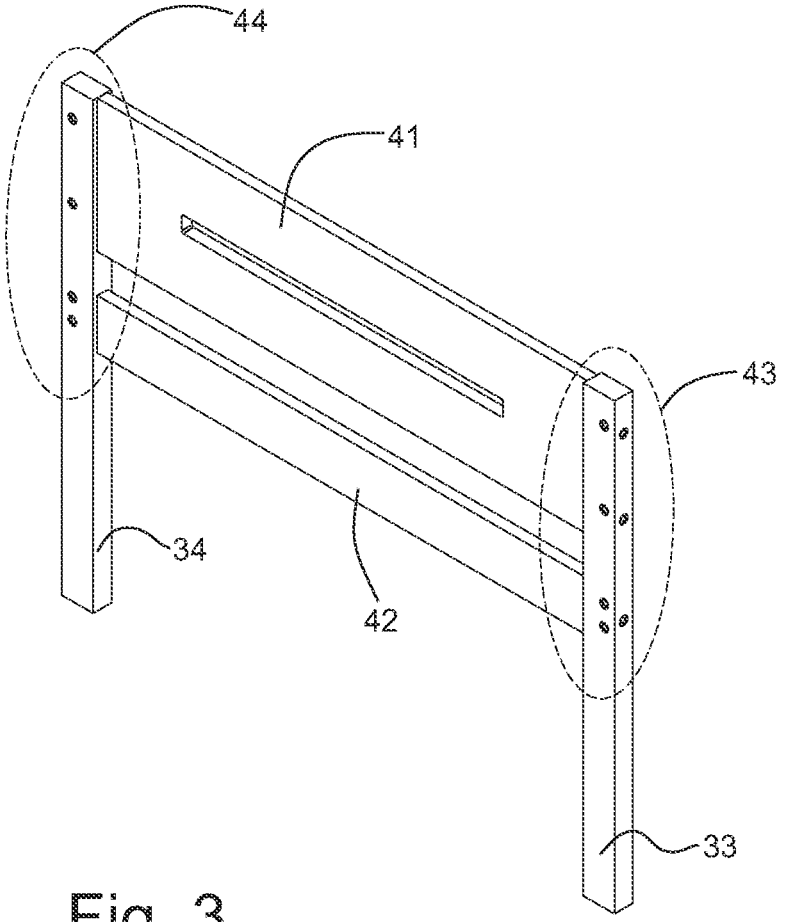
FIG. 3 is a diagram of the left upper connecting board assembly.

As seen in FIG. 3, the upper fourth leg 34 has a left upper rear connection 44 and the upper third led 33 has a left upper front connection 43. The left upper connecting Board 41 connects between the left upper front connection 43 and the left upper rear connection 44. Also, the left upper connecting beam 42 connects between the left upper front connection 43 and the left upper rear connection 44.

Figure 4:
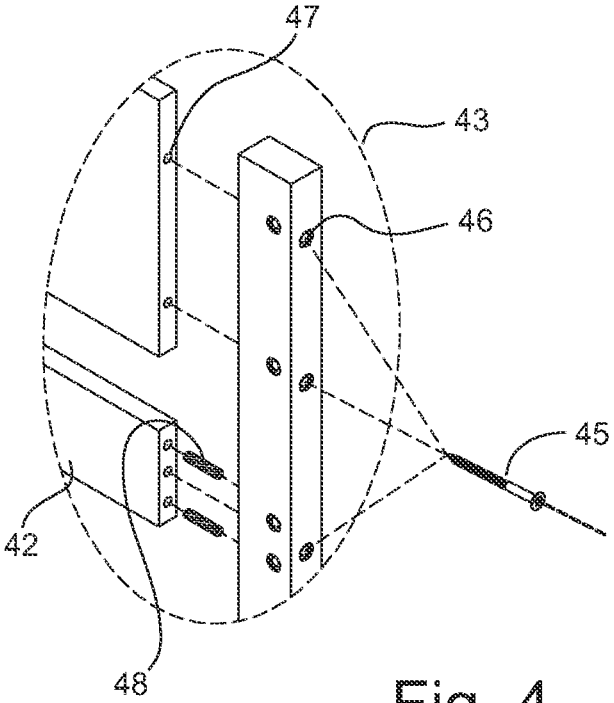
FIG. 4 is a diagram of the left upper front connection.

As seen in FIG. 4, the left upper front connection 43 can connect to the upper third leg 33 at a number of screw holes 46 that match board screw holes 47 on the left upper connecting board 41. Additionally, the left upper connecting beam 42 can connect to the left upper front connection 43 using dowels 48. Screw connectors 45 can pass through the screw holes 46 and also connect between dowels 48 to provide stability.

Figure 5:
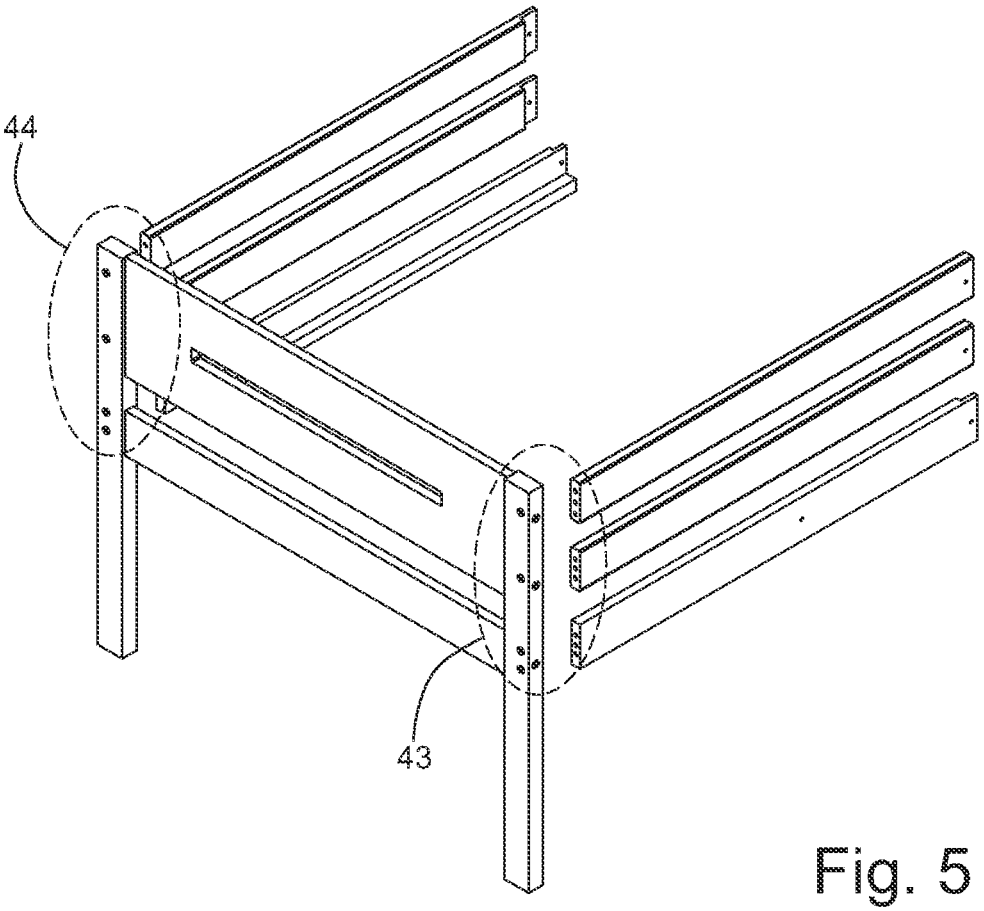
FIG. 5 is an expanded diagram of the left upper connecting board assembly.
Figure 6:
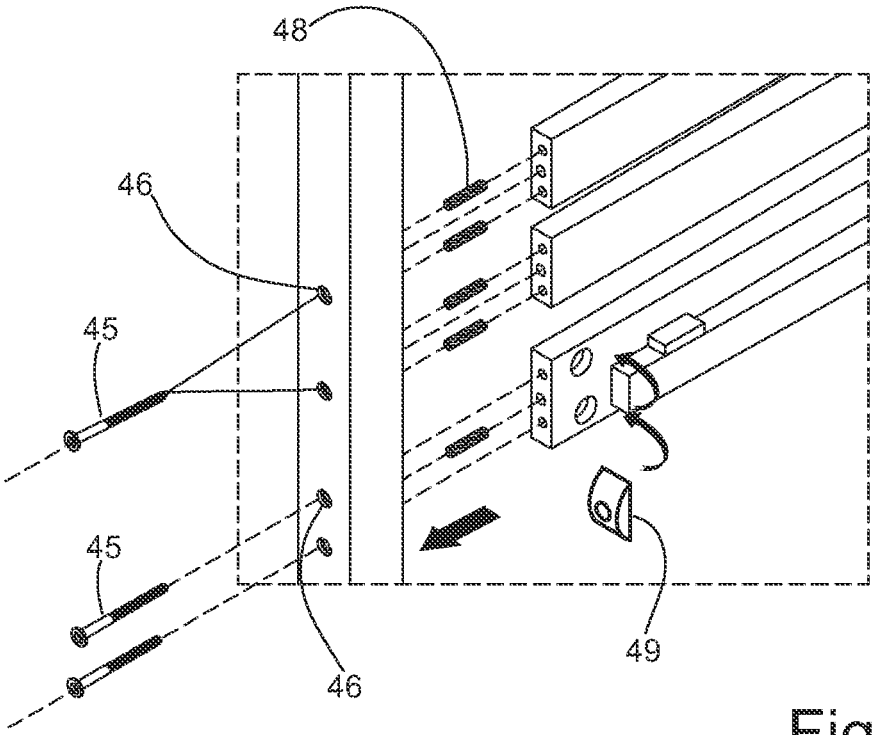
FIG. 6 is a close-up view of the left upper front connection.
Figure 7:
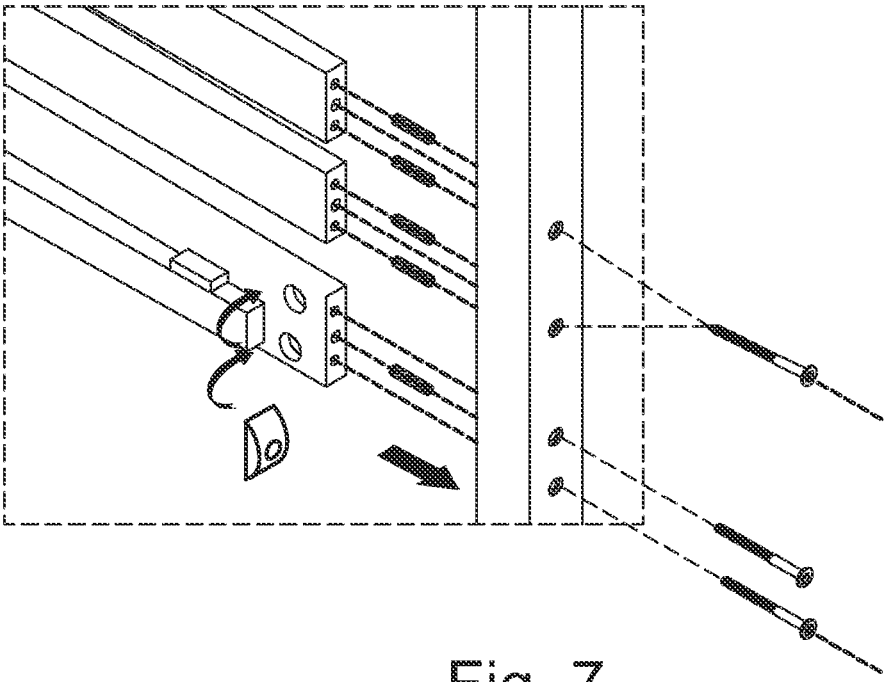
FIG. 7 is a close-up view of the right upper front connection.
Figure 8:
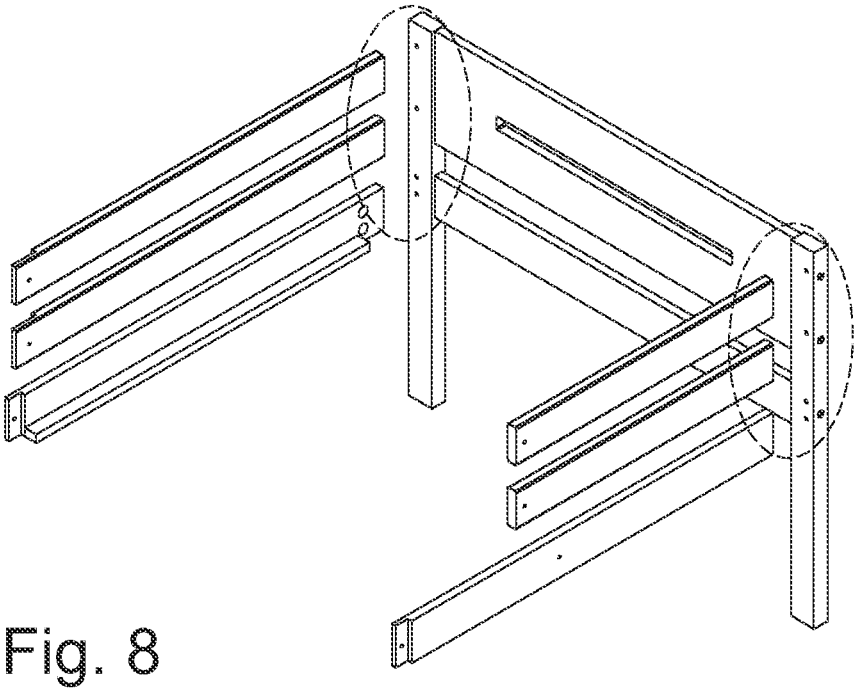
FIG. 8 is a diagram of the right upper connecting board assembly.
Figure 9:
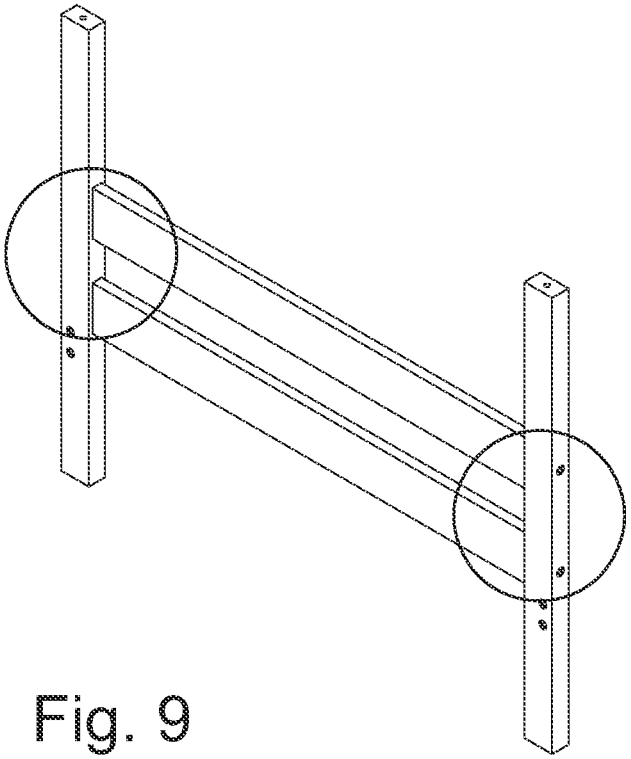
FIG. 9 is a close-up view of the left lower board assembly.
Figure 10:
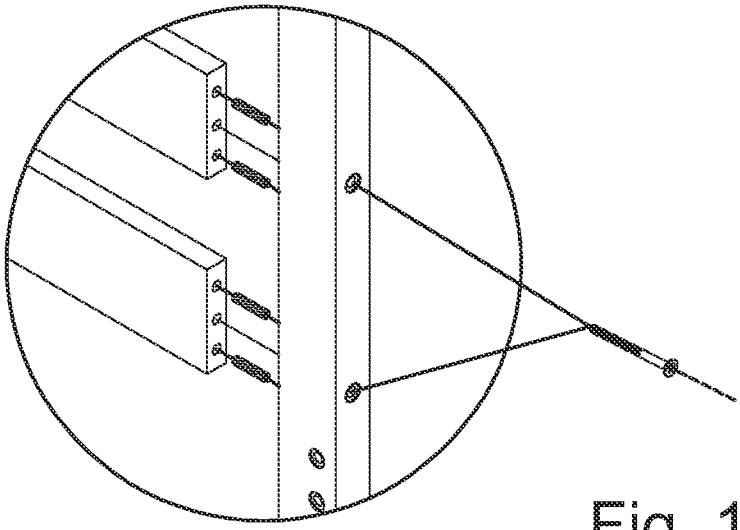
FIG. 10 is a close-up view of the left lower front connection.

As seen in FIGS. 5-6, an endcap 49 can be formed to fit into an endcap opening so that a bolt or screw 45 can pass through the screw hole 46 and connect to the endcap 49. In conjunction with dowels 48, the endcap 49 can improve stability. The endcap 49 acts as a nut that is shaped to fit inside the endcap opening.

As seen in FIGS. 7-10, the right side connection has the same structure as the left side connection such that the right side connection is basically a mirror image of the left side connection.

Figure 11:
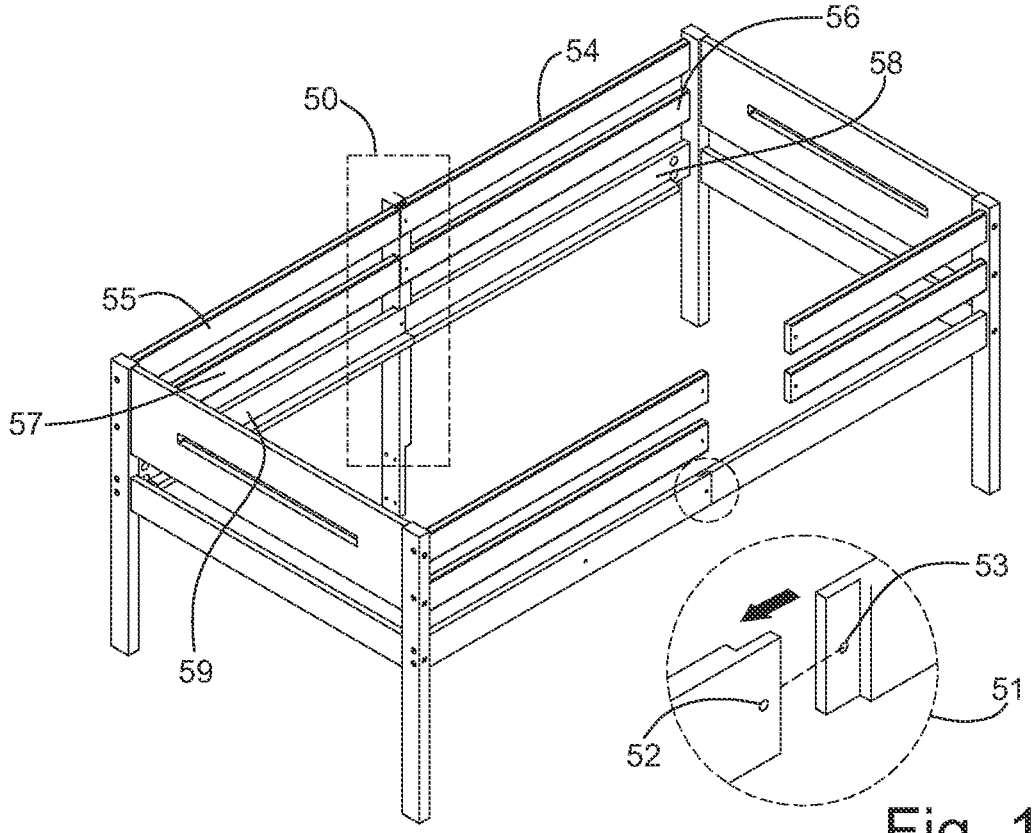
FIG. 11 is a diagram showing assembly of the upper bed.
Figure 12:
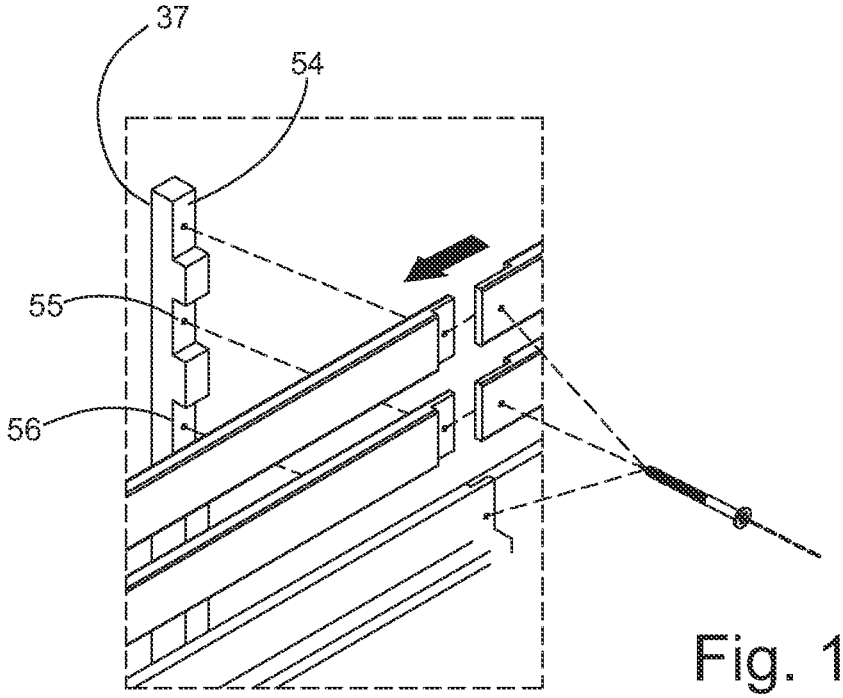
FIG. 12 is a diagram showing the middle horizontal splice junction.

As seen in FIGS. 11-12, the upper right beam 54 is parallel to the upper left beam 55. The upper right beam connects to the upper left beam at the middle horizontal splice junction 50. The upper middle leg 37 has an upper notch 154, a middle notch 155, and a lower notch 156. The notches face inwardly and support the horizontally connecting beams. The upper notch 154 receives a left end of the upper right beam 54 and the right end of the upper left beam 55. The middle notch 155 receives the right end of the middle left beam 57 and the left end of the middle right beam 56. The lower notch 156 receives the left end of the lower right beam 58, and receives the right end of the lower left beam 59. The notch joins the beams. The beams further have a lap connection having a width of the width of the second upper middle leg 37. For example, a half lap horizontal splice 51 shown in the detail exploded view shows a first splice screw hole 51 aligned to a second splice screw hole 52 at the middle horizontal splice junction 50.

Figure 13:
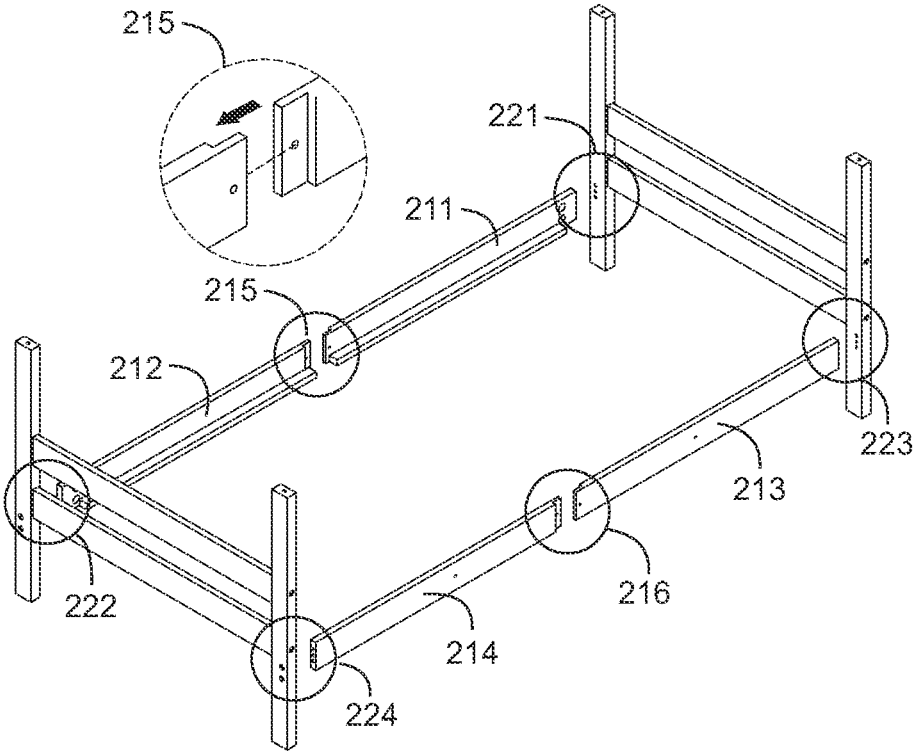
FIG. 13 is a diagram showing the assembly of the lower bed.
Figure 13:
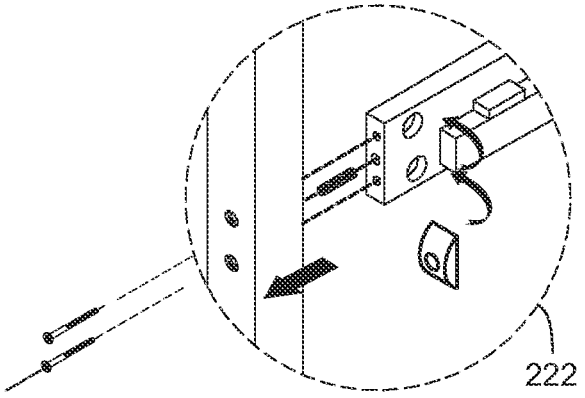

As seen in FIG. 13, the lower bed frame 20 has the same general construction as the upper bed frame 30. The lower bed frame 30 also has a lap connection at its middle portion. The lap connection of the longest members effectively shortens the longest member such that the longest member is now only one half of the original length. By shortening the longest member, the length of the product packaging carton can now be halved.

The lower bed frame 20 has a right rear longitudinal member 211, left rear longitudinal member 212, right front longitudinal member 213 and right rear longitudinal member 214. The longitudinal members are connected to each other at the rear longitudinal member connection 215 and the front longitudinal member connection 216. Each of the longitudinal members are connected at the corners, namely the right rear longitudinal member corner connection 221, left rear longitudinal member corner connection 222, right front longitudinal member corner connection 223, and right rear longitudinal member corner connection 224. The rear longitudinal member connection 215 incorporates the middle rear leg and the right rear longitudinal member 211 and left rear longitudinal member 212 both fit into the slot of the middle rear leg. Analogously, the front longitudinal members fit into the slot of the middle front legs. The upper frame has a similar structure with longitudinal members being connected to each other at the middle legs. The longitudinal members support the mattress supports which support the mattresses.

Figure 14:
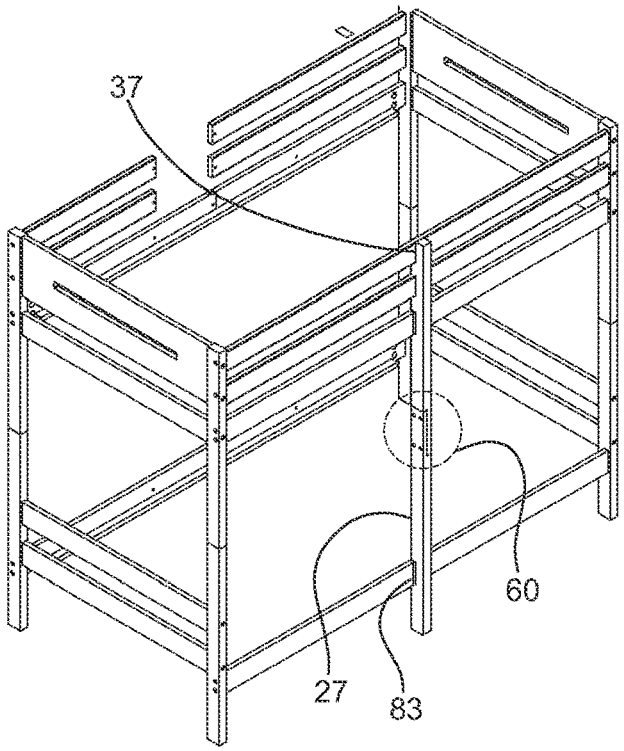
FIG. 14 is a diagram showing the middle leg lap vertical splice joint.
Figure 14:
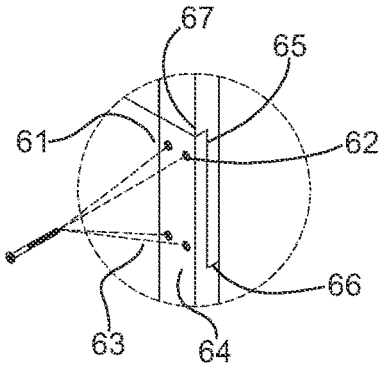

As seen in FIG. 14, the middle leg lap splice joint 60 joins the upper and lower portion of a middle leg and the stabilizers the lower middle leg notch 83. The lap splice joint has multiple connections that can be by bolts or screws, such as a first lap connection 61, a second lap connection 62, a third lap connection 63, and a fourth lap connection 64. The connections are preferably formed as drilled openings that can be bolted or screwed together. The connections are preferably in a rectangular pattern to stabilize the lap interface plane 65 which is formed between the upper and lower members. The upper lap end 67 preferably abuts the lower member, and the lower lap end 66 preferably abuts the upper member.

Figure 15:
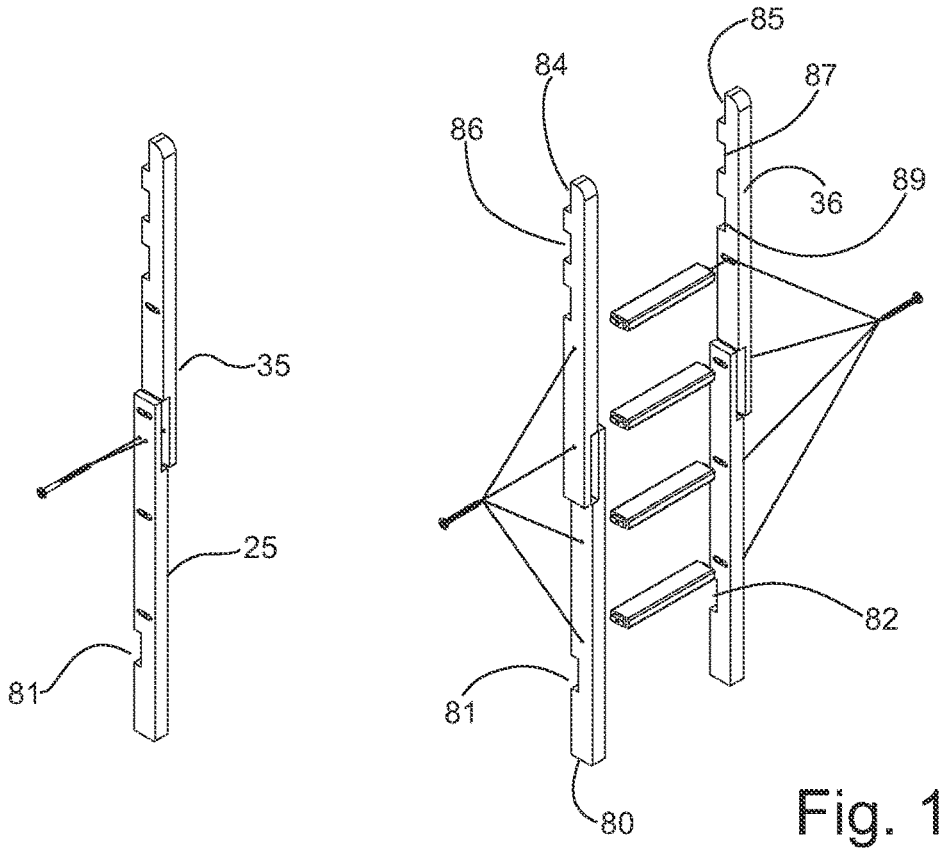
FIG. 15 is a diagram showing ladder assembly details.
Figure 16:
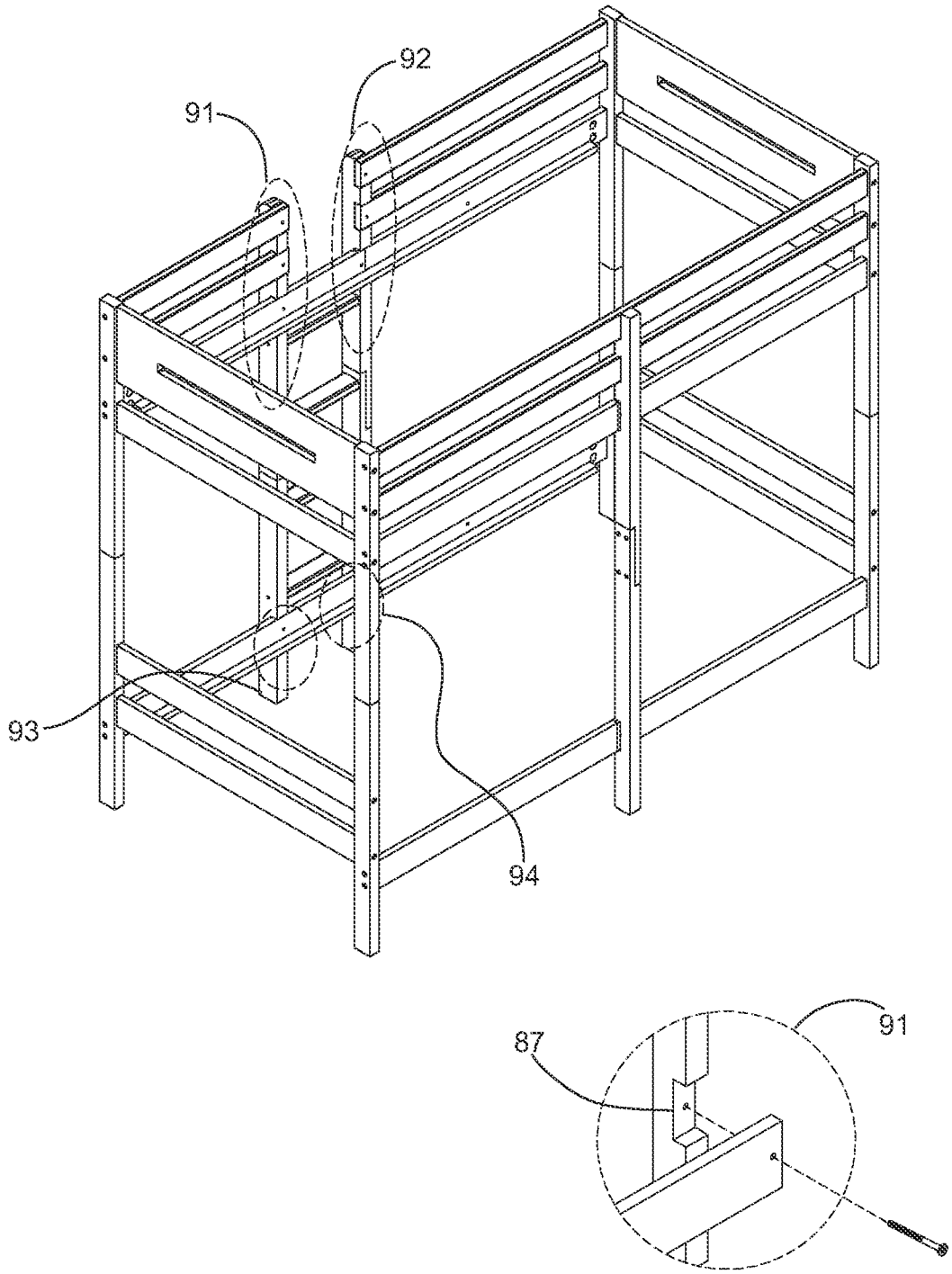
FIG. 16 is a diagram showing the lower left ladder connection.

As seen in FIGS. 15-16, the ladder legs are two part with an upper portion and a lower portion. The ladder 80 has a lower first ladder leg 25 and an upper first ladder leg 35. The lower first ladder leg 25 has a lower first ladder leg notch 81. The lower first ladder leg notch 81 receives and supports the lower left ladder connection 94. The upper first ladder leg 35 supports the upper left ladder connection 92. The upper left ladder connection 92 has an upper first ladder leg 35 which has a an upper left ladder first notch 84, an upper left ladder second notch 86, and an upper left ladder third notch 88. The right upper ladder connection 91 is formed on the upper second ladder leg 36. The right upper ladder connection 91 has an upper right ladder first notch 85, an upper right ladder second notch 87, and an upper right ladder third notch 89. Rungs extend between the ladder legs. The upper right ladder connection 91 has an upper right ladder second notch 87 which receives a horizontal member.

The upper second ladder leg 36 has a lap joint with the lower second ladder leg 26. The upper first ladder leg 35 has a lap joint with the lower first ladder leg 25. Four rungs can connect the right ladder leg with the left ladder leg. The four rungs can be inset in slots or dadoes. The bed frame thus incorporates the ladder legs and middle legs as structure for supporting a middle portion of the bed. The bed frame is preferably made of wood. After bed frame assembly, a user can install a pair of mattresses.

The invention claimed is:

1. A bunk bed frame comprising:

a. a lower bed frame and an upper bed frame, wherein the lower bed frame and the upper bed frame both have four corner legs and at least one pair of middle legs, wherein the at least one pair of middle legs is asymmetrical such that a rear middle leg is formed as a post and a front middle leg is formed as a ladder, the rear middle leg comprising an upper middle leg and a lower middle leg;

b. a rectangular configuration adapted for a full size mattress, the corner legs and middle legs providing support for the mattress; and c. a middle leg lap vertical splice joint connecting the at least one pair of middle legs, wherein the middle leg lap vertical splice joint joins the upper middle leg to the lower middle leg of the rear middle leg at a lap interface plane formed between the upper middle leg and the lower middle leg, wherein the middle leg lap vertical splice joint comprises a first lap connection, a second lap connection, a third lap connection, and a fourth lap connection, each of the first, second, third, and fourth lap connections being formed as a drilled opening configured to receive a bolt or a screw, and wherein the first, second, third, and fourth lap connections are arranged in a rectangular pattern stabilizing the lap interface plane.

2. The bunk bed frame of claim 1, wherein the first lap connection is disposed on an upper end of the lower middle leg, the second lap connection is disposed on a lower end of the upper middle leg, and the lap interface plane connects the first lap connection and the second lap connection.

3. The bunk bed frame of claim 2, wherein the third lap connection is disposed on the lower end of the upper middle leg, and the fourth lap connection is disposed on the upper end of the lower middle leg.

4. The bunk bed frame of claim 1, wherein the corner legs are formed as rectangular prism elongated posts having a rectangular cross-section.

5. The bunk bed frame of claim 1, wherein each of the corner legs has connector openings to allow connection between the corner legs, which are configured to be vertically oriented, and horizontal connecting members.

6. The bunk bed frame of claim 1, further comprising: a ladder for accessing the upper bed frame, wherein the front middle leg is formed as the ladder; and ladder legs connected to the upper bed frame and the lower bed frame, the ladder legs having notches for connecting to the lower bed frame and to the upper bed frame, wherein each of the ladder legs comprises an upper ladder leg and a lower ladder leg joined at a ladder leg lap joint.

7. The bunk bed frame of claim 6, wherein the ladder legs and the at least one pair of middle legs further comprise:

a. a lower first ladder leg notch on a lower first ladder leg;
b. a lower middle leg notch on a lower middle leg;
c. an upper left ladder first notch on an upper first ladder leg;
d. a lower second ladder leg notch on a lower second ladder leg;
e. an upper right ladder first notch on an upper second ladder leg;
f. an upper left ladder second notch on the upper first ladder leg;
g. an upper right ladder second notch on the upper second ladder leg; and
h. an upper right ladder third notch on the upper second ladder leg.

8. The bunk bed frame of claim 6, further comprising:

a. an upper right ladder connection on an upper end of the upper second ladder leg;
b. an upper right ladder third notch on an upper end of the upper second ladder leg;
c. an upper left ladder connection on an upper end of the upper first ladder leg; and
d. a lower right ladder connection and a lower left ladder connection connected to the lower bed frame.

9. A bunk bed frame structure comprising: a lower bed frame and an upper bed frame, each of the bed frames comprising four corner legs having connector openings, and at least one pair of middle legs supporting the middle of the bunk bed frame structure, wherein the middle legs are asymmetrical and comprise a rear middle leg and a front middle leg, wherein the rear middle leg is formed as a post comprising an upper middle leg and a lower middle leg, and the front middle leg is formed as a ladder, wherein the rear middle leg comprises a middle leg lap vertical splice joint joining the upper middle leg to the lower middle leg, at a lap interface plane formed between the upper middle leg and the lower middle leg and wherein the upper middle leg comprises an upper notch, a middle notch, and a lower notch, the upper notch, the middle notch, and the lower notch facing inwardly and receiving ends of horizontal beams of the upper bed frame such that the horizontal beams are joined at the rear middle leg.

10. The bunk bed frame structure of claim 9, wherein the middle leg lap vertical splice joint further comprises the lap interface plane, a lower lap end, and an upper lap end, wherein the lower lap end abuts the upper middle leg and the upper lap end abuts the lower middle leg.

11. The bunk bed frame structure of claim 9, wherein the rear middle and front middle legs each have a first notch, a second notch, and a third notch.

12. The bunk bed frame structure of claim 9, wherein the middle leg lap vertical splice joint comprises a half lap vertical splice, a first splice screw hole, and a second splice screw hole.

13. The bunk bed frame structure of claim 9, wherein the upper bed frame is connected to two ladder legs forming the ladder with rungs connecting between the two ladder legs, wherein the ladder legs have notches for connecting to the upper bed frame and to the lower bed frame, and wherein each of the two ladder legs comprises an upper ladder leg portion and a lower ladder leg portion joined at a ladder leg lap joint.

14. The bunk bed frame structure of claim 9, wherein the lower bed frame is connected to a first ladder leg, a second ladder leg, and the lower middle leg, wherein the first ladder leg has notches for connecting to the lower bed frame and to the upper bed frame.

* * * * *